United States Patent [19]

Piesik

[11] Patent Number: 4,756,226

[45] Date of Patent: Jul. 12, 1988

[54] MISSILE SUPPORT STRUCTURE FOR A LAUNCH TUBE

[75] Inventor: Edward T. Piesik, Pomona, Calif.

[73] Assignee: General Dynamics, Pomona Division, Pomona, Calif.

[21] Appl. No.: 118,673

[22] Filed: Nov. 9, 1987

[51] Int. Cl.[4] ..... F41F 3/04

[52] U.S. Cl. ..... 89/1.8; 89/1.816; 102/520

[58] Field of Search ..... 89/1.816, 1.809, 1.810, 89/1.8

[56] References Cited

U.S. PATENT DOCUMENTS

| | | | |
|---|---|---|---|
| H405 | 1/1988 | Covey | 102/520 |
| 2,445,423 | 7/1948 | Eastman | 89/1.8 |
| 3,081,970 | 3/1963 | Einarsson | 89/1.8 |
| 3,148,472 | 9/1964 | Hegge et al. | 102/521 |
| 3,160,061 | 12/1964 | Moy | 89/1.816 |
| 3,289,533 | 12/1966 | Brown | 89/1.809 |
| 3,861,271 | 1/1975 | Osborn, Jr. | 89/1.8 |
| 4,044,648 | 8/1977 | Piesik | 89/1.8 |
| 4,134,327 | 1/1979 | Piesik | 89/1.8 |
| 4,186,647 | 2/1980 | Piesik | 89/1.8 |
| 4,324,167 | 4/1982 | Piesik | 89/1.8 |
| 4,399,999 | 8/1983 | Wold | 89/1.816 |
| 4,433,848 | 2/1984 | Williams | 89/1.816 |
| 4,464,972 | 8/1984 | Simon | 89/1.816 |
| 4,485,719 | 12/1984 | Mendelsohn et al. | 89/1.816 |
| 4,604,940 | 8/1986 | Mendelsohn et al. | 89/1.816 |
| 4,686,884 | 8/1987 | Piesik | 89/1.816 |

*Primary Examiner*—David H. Brown

*Attorney, Agent, or Firm*—Neil F. Martin; Edward B. Johnson

[57] ABSTRACT

A missile support structure comprises at least two sabots or packing bodies which surround a missile in a launch tube and extend along at least part of its length. The sabots substantially fill the gap between the outer surface of the missile and the walls of the launch tube to restrict lateral movement. A capture assembly is provided to capture the sabots at the launch tube exit as the missile leaves the tube, and a return mechanism is provided on each sabot for intercepting the missile exhaust flow to urge the sabots back down into the launch tube.

8 Claims, 2 Drawing Sheets

MISSILE SUPPORT STRUCTURE FOR A LAUNCH TUBE

BACKGROUND OF THE INVENTION

The present invention relates generally to support or packing structures for surrounding missiles or other exhaust gas propelled vehicles in launch tubes or containers to prevent or restrict lateral movements during transportation or other shocks to the tube, and to maintain the vehicle in alignment with the launch tube axis.

Such packing structures generally comprise seals or sabot bodies which are configured to fill the gap between the missile and launch tube or canister. One disadvantage in such structures is that they have to be released or jettisoned on launch of the vehicle, and therefore fall to the ground around the launch tube site where they cause unwanted debris and additionally could damage ground facilities.

In U.S. Pat. Nos. 3,160,061 of Moy and 3,861,271 of Osborn, Jr., foam structures for surrounding missiles or vehicles prior to launch are shown. These structures are propelled out of the launch container with the vehicle before becoming separated and falling back to the ground. In U.S. Pat. No. 4,464,972 of Simon a lateral support system for a canister launched missile is shown, which comprises a series of long, flexible elastomer pads which are hinged near the canister exit opening. The pads are peeled from the surface of the missile as it exits the canister and remain attached to the exit opening at their lowermost hinged ends.

SUMMARY OF THE INVENTION

It is an object of the present invention to provide an improved missile support structure for supporting a missile or other exhaust propelled vehicle within a launch tube.

According to the present invention a support assembly is provided which comprises a plurality of sabots for surrounding a vehicle in a launch tube and substantially filling the gap between the vehicle and launch tube walls. The sabots extend along at least part of the length of the vehicle. A capture arrangement is provided to capture the sabots as the vehicle leaves the launch tube exit so that they are not propelled upwardly with the vehicle. A return assembly is provided on the sabots which is arranged to return the sabots down into the launch tube after launch. Preferably, the return assembly comprises suitable flaps or the like which are arranged to intercept the missile exhaust flow as the missile moves away from the captured sabots, the force of the exhaust flow interacting with the flaps urging the sabots back down into the launch tube.

Thus, not only does the assembly prevent random debris from the support structure from falling around the launch tube location, it also returns the sabot structure back into the launch tube after launch so that it is not left on the ground adjacent the launch site. The sabots will also restrict a large proportion of the exhaust gases from flowing back down into the launch tube after launch, protecting it from excessive heating.

In one embodiment of the invention the capture arrangement comprises a plurality of hooks arranged at or adjacent to the launch tube exit, and a plurality of corresponding eyes or rings arranged at the lower edge of the sabots in alignment with the capture hooks. As the sabots leave the launch tube, their eyes will be caught on the capture hooks, causing the sabots to pivot outwardly away from the missile. The exhaust from the missile will impinge on the sabots, return flaps on the sabot bodies will open so that the exhaust pressure on the flaps will rotate the sabots back into alignment with the launch tube, and subsequently back down into the tube.

In an alternative arrangement, the capture structure may comprise a series of resilient or spring-like lines, each line securing a respective one of the sabots to a suitable point on the launch tube wall. This will help to urge the sabots back into the launch tube after launch.

BRIEF DESCRIPTION OF THE DRAWINGS

The present invention will be better understood from the following detailed description of a preferred embodiment of the invention, taken in conjunction with the accompanying drawings, in which like reference numerals refer to like parts and in which.

DESCRIPTION OF THE PREFERRED EMBODIMENT

Figure 1:
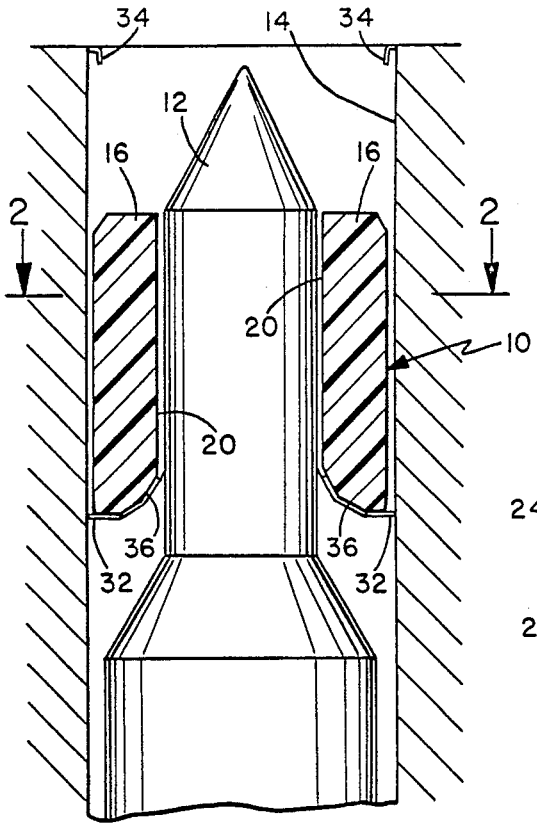
FIG. 1 is a side elevation view of a portion of a typical missile with the launch tube and support structure according to a preferred embodiment of the invention.
Figure 2:
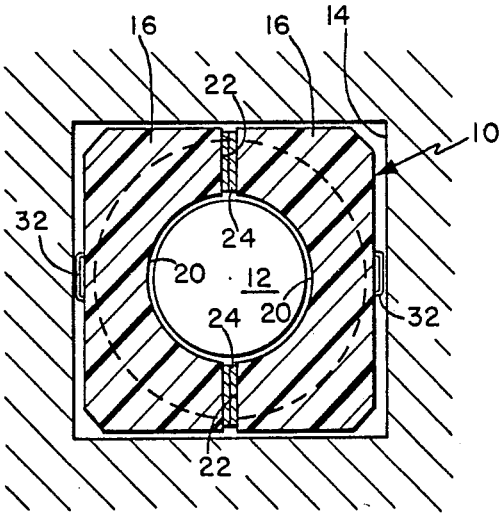
FIG. 2 is a sectional view taken on line 2—2 of FIG. 1.

FIGS. 1 and 2 show a missile support structure 10 according to a preferred embodiment of the present invention for supporting a missile 12 in a launch tube or container 14. As shown in FIGS. 1 and 2 the structure 10 comprises two sabots or packing bodies 16 which surround the outer surface of the missile and substantially fill the gap between the missile and the launch tube walls. The sabots are lightweight packing pieces and may even be airbags. They will restrict excessive lateral movement of the missile or other vehicle 12 during transportation or other shocks.

In the preferred embodiment shown in FIGS. 1 and 2, two sabots 16 are provided which are of split donut shape, each having a semicircular inner cut out 20 for surrounding part of the missile and a generally square-section outer surface for fitting against the launch tube walls. The sabots have flat inner faces 22 which are in face to face relationship as shown in FIG. 2 when they are positioned surrounding the missile 12. Although two sabots are provided in the preferred embodiment, more than two sabots may be used in alternative embodiments and the sabot outer periphery may be of other geometrical shapes depending on the launch tube cross section, e.g. it may have a circular outer periphery for cylindrical launch tubes. The two sabots 16 shown may be split into four or more symmetrically arranged sabots in alternative arrangements.

Figure 3:
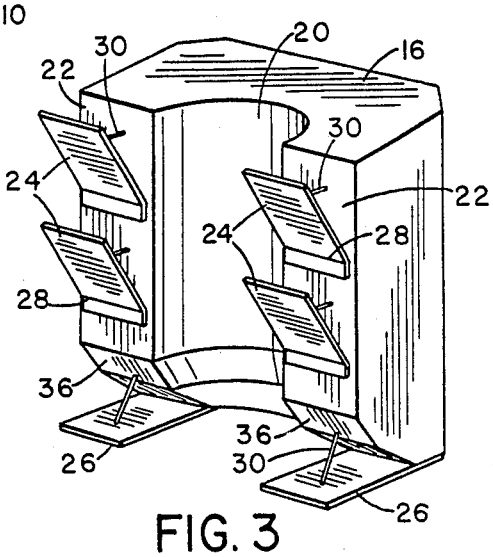
FIG. 3 is an inside perspective view of one sabot element.
Figure 4:
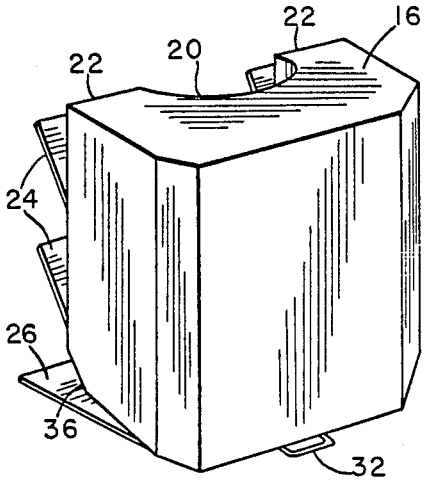
FIG. 4 is an outside perspective view of the sabot element.

One of the sabots 16 is shown in more detail in FIGS. 3 and 4. Each sabot member is provided with a return assembly for returning the sabots back into the launch tube after launch, as explained in more detail below. In the preferred embodiment of the invention, the return assembly comprises a series of upwardly facing, vertically spaced return flaps 24 on the inner faces 22 of each sabot, as best shown in FIGS. 3 and 4. An additional inwardly facing flap 26 is provided on the lower face of each sabot. Each flap 24 is pivoted at its lower end to the sabot body at 28, and its upper end is free. Flap 26 is pivoted at its inner end to the sabot body as seen in FIG. 3. The flaps 24 and 26 may be adhesively or mechanically pivoted to the sabot bodies. The free end of each flap is preferably supported by a line 30 or the like which secures it to the sabot body to prevent the flap from falling open beyond a certain extent. The flaps may be spring-loaded towards their open position shown in FIG. 3.

Each sabot has a ring or eye 32 on its lower, outer edge, as best seen in FIG. 4, which forms part of a capture arrangement for capturing the sabots as they leave the launch tube so that they are not carried upwardly away from the launch tube exit. Each ring 32 is aligned with a corresponding downwardly facing hook 34 at the launch tube exit, as shown in FIG. 1, which captures the ring 32 as the missile leaves the launch tube, as explained in more detail below. One or more hooks and corresponding eyes may be provided for capturing each sabot.

Figure 10:
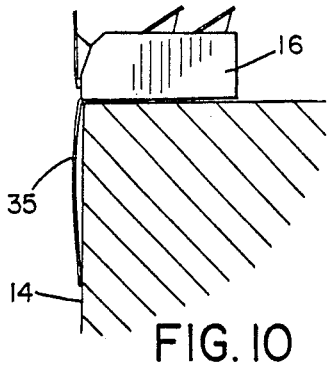
FIG. 10 is a partial view showing an alternative sabot capture arrangement.

Although a hook and eye capture arrangement is shown in the preferred embodiment, an alternative arrangement may be provided in which each sabot is secured to the launch tube wall by a respective resilient or spring-like line 35, as indicated in FIG. 10. The lines will be secured at an appropriate height in the launch tube so that the sabots cannot travel up away from the launch tube exit to any significant extent. The other end of each line is secured to a lower, outer edge point on the respective sabot. Other alternative capture arrangements may also be used to retain the sabots at the level of the launch tube exit.

Figure 5:
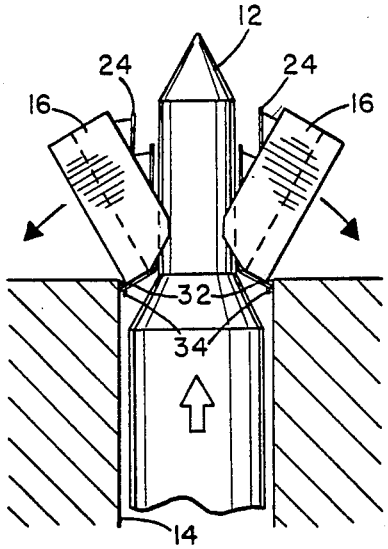
FIGS. 5–9 illustrate the firing sequence in which the sabot elements are ejected from the launch tube, but are retained and blown back into the launch tube by the missile exhaust.

Operation of the sabot assembly on launch of the missile or other vehicle 12 will now be described with reference to the launch sequence illustrated in FIGS. 5 to 9. On firing of the missile, the sabots will move with the missile up the launch tube. As the sabots emerge from the tube, the eye or eyes at the lower, outer edge of each sabot will be caught by the respective aligned hook or hooks at the upper end of the launch tube, as shown in FIG. 5. Alternatively, the sabots will be held back at this point by flexible lines with the alternative capture arrangement described above. This latter capture arrangement is preferable since the tensioned lines will tend to pull the sabots back into the launch tube.

Figure 6:
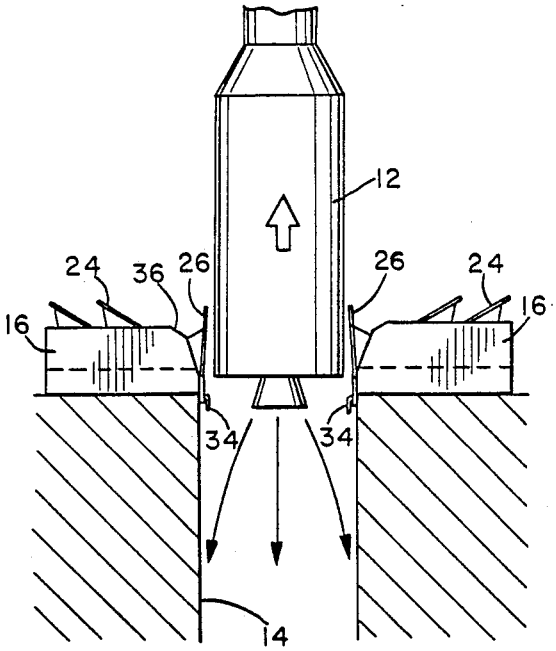

Since the lower edge of each sabot is held back by the capture arrangement, the sabot body will start to rotate or pivot outwardly about its lower edge, as shown in FIG. 5. The inner, lower edge of each sabot is preferable rounded or formed with an incline or radius 36, as seen in FIGS. 5 to 9, so that it will not interfere or wedge with the missile surface on rotation. The missile continues to accelerate out of the launch tube while the sabot pieces come to rest on the ground adjacent the launch tube exit as shown in FIG. 6, still attached to the capture hooks.

Figure 7:
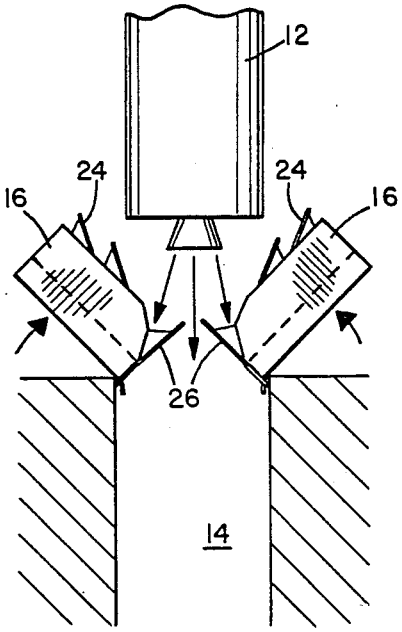
Figure 8:
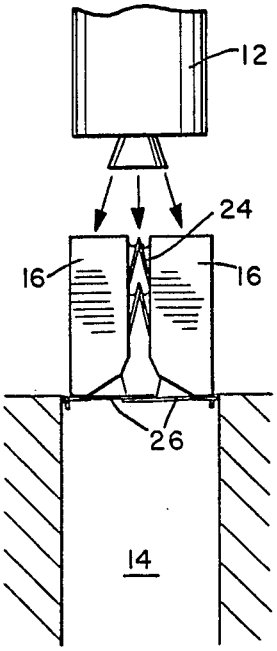
Figure 9:
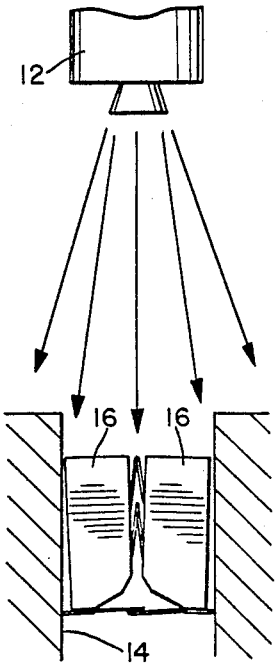

As the exhaust from the rocket impinges on the sabot pieces, the lower end flaps 26 will be dragged open by the exhaust. The flaps 24 and 26 are arranged to intercept the exhaust flow at various stages, so that at the point shown in FIG. 6, the force of the exhaust acting on the lower end flaps will start to rotate the sabots back up towards the launch tube centerline, as shown in FIG. 7. The remaining flaps will fall open as shown, and the exhaust will start to act on these flaps to rotate the sabots back up into a vertical orientation as shown in FIG. 8. At this point the exhaust acts on the flaps as well as the upper end of each sabot to force it back down into the launch tube as the missile accelerates away, as shown in FIG. 9. The volume of the sabot bodies in the launch tube will restrict the available exhaust flow area, preventing substantial amounts of exhaust gas from entering the tube, and thus will additionally protect the exhaust tube walls from excessive heating.

The sabot bodies may be of any suitable lightweight packing material and may be coated with ablative material for withstanding the temperature and pressure of the exhaust gases as they are forced back down into the launch tube. The flaps may be of metal and will also be coated with ablative material.

The support structure described above thus protects the missile or vehicle from excessive vibration or lateral movement prior to launch, and is captured on leaving the launch tube so that it will not fall randomly to the ground as undesirable and possibly dangerous debris. The capture arrangement acts to rotate the sabots away from the missile body as it leaves the launch tube, so that they do not impede its flight. The sabot pieces are not left lying on the ground after launch, but are instead urged back down into the launch tube so that there is no debris on the ground after launch. Additionally, the sabot structure will prevent excess amounts of exhaust gases from entering the launch tube as the missile is moving away from the exit.

Although a preferred embodiment of the present invention has been described above by way of example only, it will be understood by those skilled in the field that modifications may be made to the disclosed embodiment without departing from the scope of the invention, which is defined by the appended claims.

What is claimed is:

1. A support assembly for supporting an exhaust propelled vehicle in a launch tube, comprising:

at least two sabots extending along at least part of the length of a vehicle in a launch tube and surrounding at least part of the outer periphery of the vehicle, the sabots substantially filling the gap between the vehicle and the launch tube walls to restrict lateral movement of the vehicle in the launch tube;

capture means for capturing the sabots at the launch tube exit; and return means for returning the captured sabots into the launch tube.

2. The assembly as claimed in claim 1, wherein the return means comprise vertically spaced flap means on the sabots for successively intercepting the exhaust gas flow as the vehicle leaves the launch tube to urge the sabots back into the launch tube.

3. The assembly as claimed in claim 2, wherein the flap means on each sabot comprise a plurality of flaps on an inner surface of the sabot each hinged at a lower end to the sabot body with their upper end free.

4. The assembly as claimed in claim 1, wherein the capture means comprises a first series of capture formations at the exit of the launch tube and a second series of cooperating capture formations at the lower end of the sabots in alignment with the first capture formations for engaging said first capture formations as the sabots leave the launch tube.

5. The assembly as claimed in claim 4, wherein the first series of capture formations comprise downwardly facing hooks and the second series of capture formations comprise eyes for being caught on the hooks as the sabots leave the launch tube.

6. The assembly as claimed in claim 1, wherein the capture means comprises at least one resilient line connecting each sabot to the wall of the launch tube.

7. A method of supporting a missile in a launch tube during launch, comprising:

surrounding the missile in the launch tube with at least two sabots extending along part of the length of the missile and substantially filling the gap between the outer surface of the missile and the launch tube walls;

moving the sabots along the launch tube with the missile during launch;

capturing the sabots at the launch tube exit as the missile exits the launch tube; and returning the captured sabots into the launch tube.

8. The method of claim 7, wherein the steps of capturing and returning the sabots comprise capturing the sabots at the lower, outer edges at the launch tube exit, causing the sabots to pivot outwardly about the capture point away from the launch tube, and intercepting the exhaust gas flow from the missile by means of flaps on the sabots to cause the sabots to pivot back up and be forced back down into the launch tube.

* * * * *